US006920808B2

(12) United States Patent
Rauch

(10) Patent No.: US 6,920,808 B2
(45) Date of Patent: Jul. 26, 2005

(54) DOUBLE-ACTION POWER PIPE WRENCH

(76) Inventor: Vernon Rauch, P.O. Box 728, Garden Valley, ID (US) 83622

( * ) Notice: Subject to any disclaimer, the term of this patent is extended or adjusted under 35 U.S.C. 154(b) by 40 days.

(21) Appl. No.: 10/094,413

(22) Filed: Mar. 8, 2002

(65) Prior Publication Data

US 2003/0167883 A1 Sep. 11, 2003

(51) Int. Cl.[7] ..... B25B 21/00; B25B 13/50
(52) U.S. Cl. ..... 81/57.17; 81/57.2; 81/57.14
(58) Field of Search ..... 81/57.14–57.2, 81/57.11, 57, 57.3, 57.31, 57.33, 57.34, 57.24, 57.25, 57.35

(56) References Cited

U.S. PATENT DOCUMENTS 1,764,221 A * 6/1930 Mills ..... 81/57.35
4,221,269 A * 9/1980 Hudson ..... 81/57.2
6,065,372 A * 5/2000 Rauch ..... 81/57.15

* cited by examiner

*Primary Examiner*—Debra S. Meislin
(74) *Attorney, Agent, or Firm*—Pedersen & Co., PLLC; Ken J. Pedersen; Barbara S. Pedersen

(57) ABSTRACT

An adjustable power wrench is provided for spinning together, and apart, sections of pipe used in long drill strings such as are typically seen in water well and oil drilling. The wrench is preferably designed for use with large diameter drill pipes or rods, including casings. Two sturdy engaging arms, each containing a pair of serrated power rollers driven by a hydraulic motor, are manually positioned about the subject pipe length. The arms are closed about the pipe by two air rams, one for each engaging arm, to engage the serrated rollers and impart spin to the pipe. The apparatus is preferably supported by wire cable in a balanced fashion from the mast of an available drill rig.

2 Claims, 4 Drawing Sheets

DOUBLE-ACTION POWER PIPE WRENCH

BACKGROUND OF THE INVENTION

1. Field of the Invention.

The invention relates, in general, to the drilling of wells. More specifically, the invention relates to the spinning together and apart segments of drill pipe such as are used in the drilling of oil and water wells.

2. Related Art.

The drilling of deep holes requires the attachment of many segments of pipe in series. These connections may conventionally be made by threading the male end at the bottom of one pipe into the female end of another. These holes are lengthened as additional pipe lengths are successively added to the drill string in this manner. To remove the drill string, this process is reversed. The present invention offers a device that makes the formation and removal of such strings easier, safer, and quicker.

A number of inventions have attended to the desire for a simple and useful machine for spinning drill pipe. These devices employ a number of different mechanisms for retaining and spinning lengths of pipe.

Rauch, U.S. Pat. No. 6,065,372, offers a power wrench for spinning drill pipe in which the subject pipe length is pressed firmly against two serrated rollers by an idler roller that is actuated by an air ram. The serrated rollers, driven by means of drive chains and a single hydraulic motor, impart spin to the pipe.

Rae, U.S. Pat. No. 5,660,087, discloses a pipe spinner in which a multiplicity of symmetrically located rollers engage and rotate drill pipe sections which are held in place under the force of a piston rod that extends via a bell crank to clamp the pipe.

Brooks, U.S. Pat. No. 4,381,685, provides a power wrench in which a single motor drives a single serrated drum designed to engage and spin the subject pipe segment. The pipe is pressed into firm contact with the serrated surface of the drum using a C-shaped clamp.

Hudson, U.S. Pat. No. 4,221,269, describes a power wrench in which a drill pipe length is received between three urethane-coated rollers that are driven by three rotary hydraulic motors to spin the pipe.

Bartos, U.S. Pat. No. 3,392,609, presents a drill pipe spinning apparatus in which a drill pipe is engaged and rotated by two sets of rollers situated one above the other. Other power wrenches for drill pipe are presented in other patents. However, none of these employ the specific configuration or realize the intrinsic advantages of the present invention.

SUMMARY OF THE INVENTION

The present invention is a device for spinning together and breaking apart the joints of drill strings used in well construction. The invention makes these processes safer, quicker, and more convenient for well drillers.

The invention comprises a wrench system that meets requirements for handling operations involving larger drilling pipes or rods, including casings, preferably 6 to 16 inches in diameter. The preferred components of the wrench include: two (2) pairs of serrated power rollers for gripping the pipe, two (2) hydraulic motors used in conjunction with two (2) pairs of drive chains and double sprockets for spinning the serrated rollers, an adjustment mechanism for the wrench to fit various size pipes, and an attachment means for moveably securing the apparatus to a drill rig. The preferred embodiment also includes a system for minimizing the operational risks associated with using the tool.

The apparatus is designed to hang, by wire cable or other suitable means, from the mast of any established drill rig and is easily positioned manually by the operator. The preferred supporting elements, which are typically available on drill rigs, include hydraulic power to run the motors and compressed air to drive the air rams. The invention preferably includes a safety feature comprising a simple switch or other suitable control means. When in the "off" position, the switch prevents the moving parts from engaging, thereby minimizing the risk of injury to machine operators.

Operation of the wrench requires first manually positioning the device's pair of arms about the subject pipe segment and securing the segment between the pairs of serrated rollers. The arms are first manually adjusted to accommodate the approximate outer diameter of the subject pipe length, and secondly the actuation of two air rams closes the arms tightly upon the pipe segment. With the pipe length gripped tightly, the two hydraulic motors spin the rollers to impart spin to the pipe. The motors continue to drive the rollers until the threaded male end of one pipe is securely seated within, or removed from, the female end of another.

DESCRIPTION OF THE PREFERRED EMBODIMENTS

With reference to the figures, several views of the invented power wrench 10 are presented. The majority of the preferred components are shown and numbered in all figures and, for illustrative purposes, a pipe length in position for spinning is included in FIGS. 2 and 3. To simplify the description, the components will be separated into two functional systems: the drive assembly and the engagement assembly.

Figure 3:
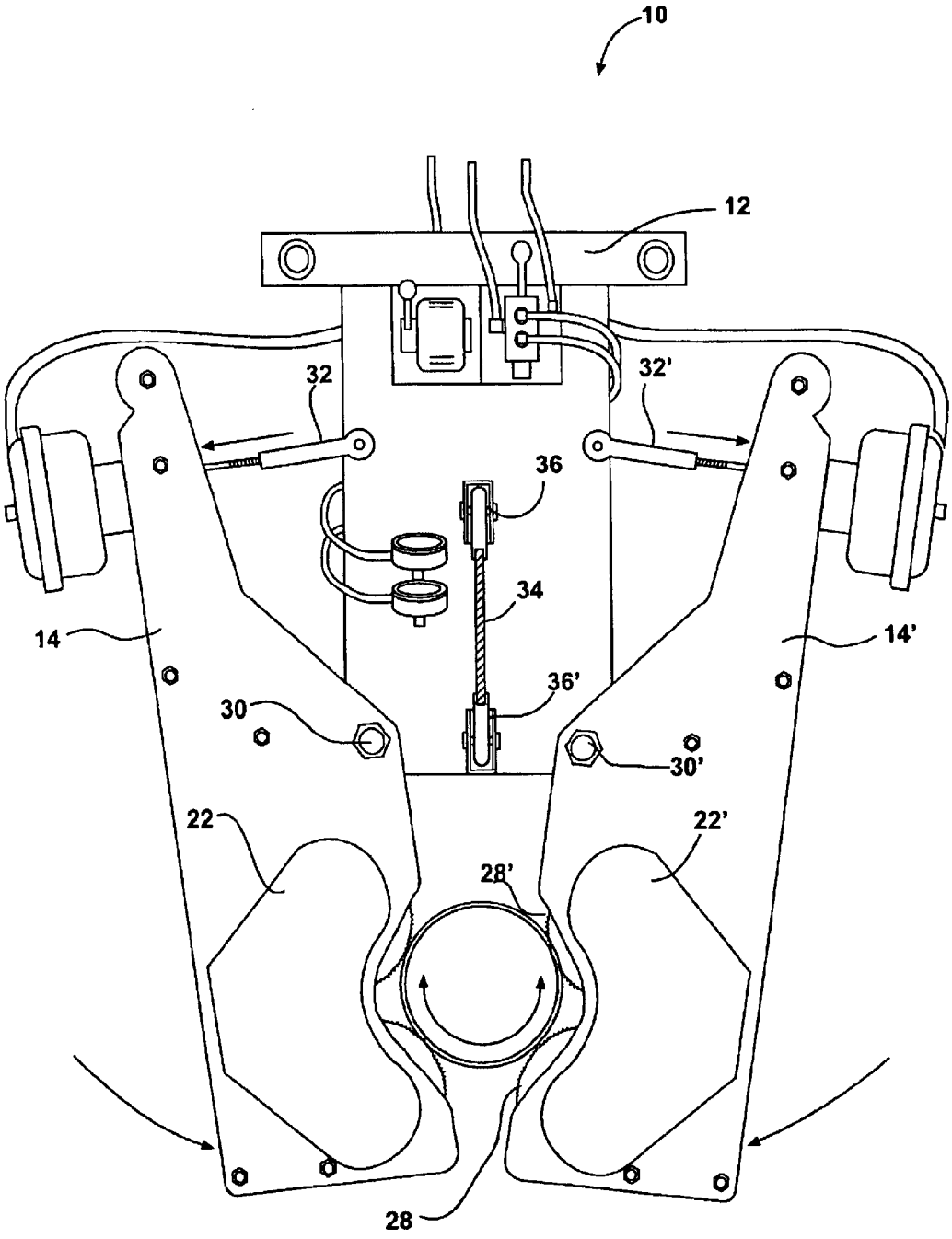
FIG. 3 is a top view of the power wrench depicted in FIG. 2, but with a smaller pipe engaged.
Figure 4:
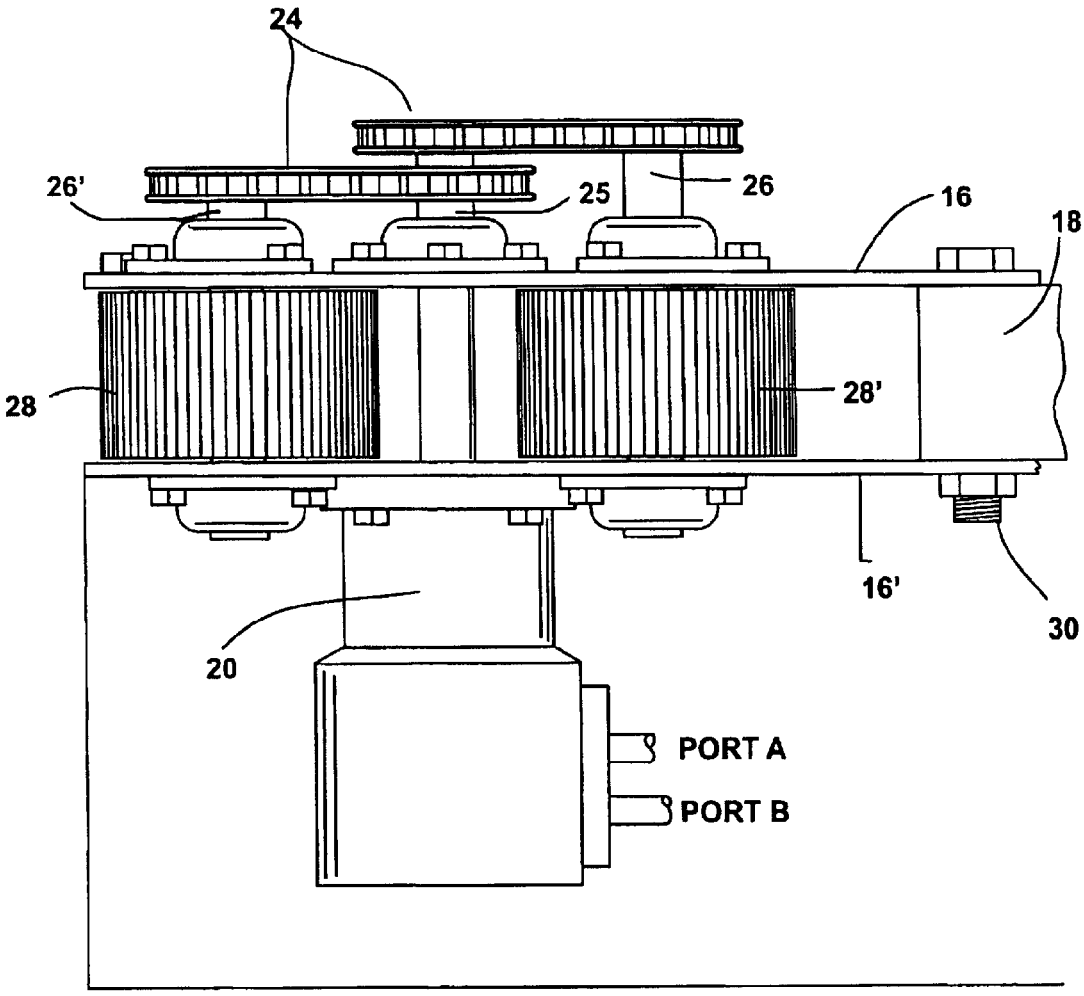
FIG. 4 is a partial, side crossectional view along lines 4—4 of FIG. 1.

The structural base for both systems is comprised of a T-shaped frame 12 and two engaging arms 14 and 14'. The frame 12 and engaging arms are shown in top view in FIGS. 1–3. The engaging arms 14 and 14' are constructed of a top and bottom cheek plate, 16 and 16', respectively with attendant bolts and spacers as shown in FIG. 4. The cheek plates 16 and 16' are moveably mounted to the frame 12 such that the wings 18 of the frame are positioned between the top and bottom cheek plate, as shown in FIG. 4. These components are preferably constructed of ⅜" T-1 steel plate, although those skilled in the art may substitute possible alternatives. The configuration of the arms and frame, such as the placement of axle holes and spacers, may vary to the extent that adjustment of the performance of the essential functions of each is still possible.

Figure 2:
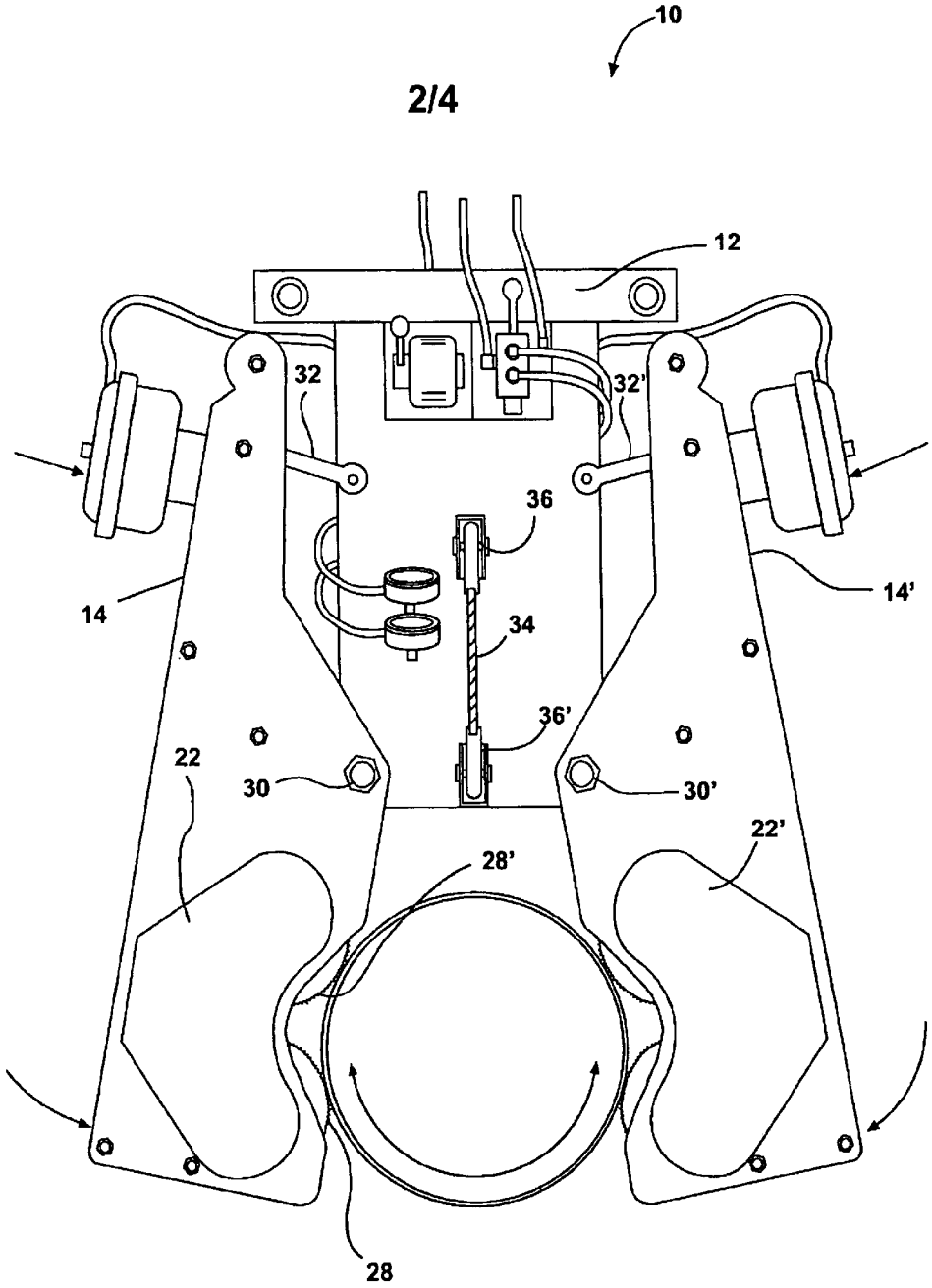
FIG. 2 is a top view of the power wrench depicted in FIG. 1, but with the chain guards installed, and with a large pipe engaged for spinning.

The drive assembly preferably includes two hydraulic motors 20 and 20', one on each engaging arm. The motors are situated beneath the operating parts and are protected by motor guards 22 and 22', respectively, as shown in FIGS. 2 and 3. Each motor will drive a pair of drive chains 24 connected to a double sprocket assembly 25. The double sprocket assembly 25 preferably comprises an upper and lower toothed sprocket portion arranged co-axially on the motor-driven axle. The double sprocket drives two endless chain drives. At the end of each drive chain, opposite the double sprocket, are upper and lower roller sprockets 26 and 26', respectively. These roller sprockets are preferably situated at or near the top of the upper and lower roller axles such that the upper roller sprocket lies in the same plane as the upper double sprocket and the lower roller sprocket lies in the same plane as the lower double sprocket. The upper and lower roller double sprockets rotate the upper and lower drive chains, respectively. Other arrangements are possible where the desired interaction between the roller sprockets and the double sprocket is accomplished. The preferred configuration incorporates 14 toothed sprockets with taper lock and number 50 chain drives with ⅝" pitch. The roller axles extend through the top and bottom cheek plates and the ends are secured to the appropriate plate by means of a sealed ball bearing or other suitable connection. Rotation of the roller sprockets drives the distal and proximal rollers, 28 and 28', respectively, which engage and spin the subject pipe length.

The serrated distal and proximal rollers are configured co-axially with the upper and lower roller sprockets. When engaged, the serrated surface grips the outer surface of the received pipe length to impart spin to the pipe. The toothed surface significantly enhances the frictional contact between the rollers and the drill pipe. The rollers in the preferred embodiment are approximately 5" in diameter and 3" wide. To initiate spinning, the hydraulic motors are started slowly once the subject pipe length is clamped tightly between the two pairs of serrated rollers situated at the forward end of the engaging arms and surrounding the pipe-receiving space, as shown in FIGS. 2 and 3.

Figure 1:
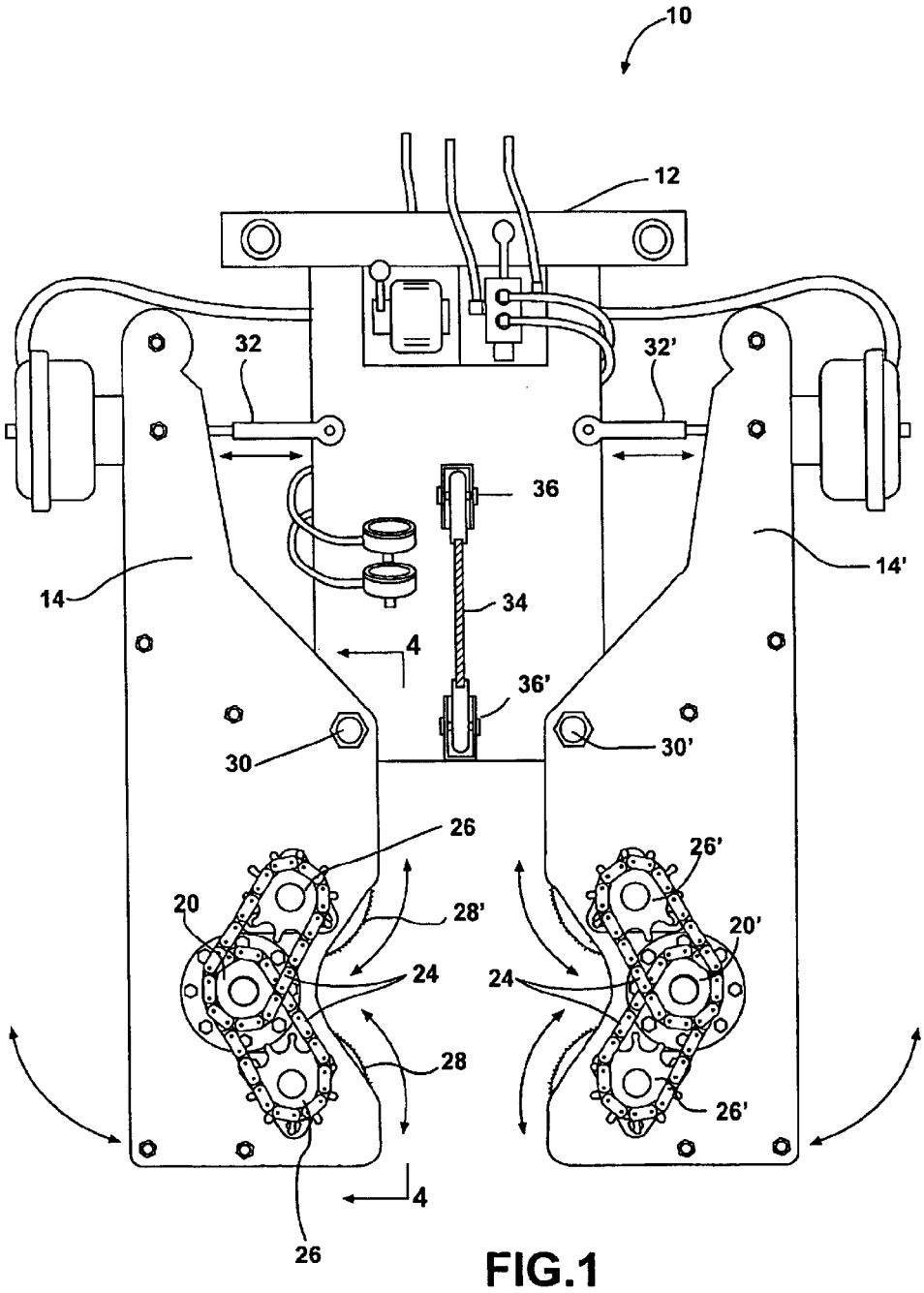
FIG. 1 is a top view of the invented power wrench with the chain guard removed for clarity.

Sufficient engagement of the drill pipe to the power rollers is accomplished by closing the engaging arms 14 and 14' tightly upon the pipe segment. The engaging arms of the preferred embodiment may be adjusted in two ways. Adjustment of the swivel pins 30 and 30' permits abduction and adduction of the engaging arms along the frame to make large adjustments. The swivel pins 30 and 30' may be secured in various positions along the wings of the frame to increase or decrease the pipe-receiving space as desired. Small adjustments, such as those required to fully clamp the pipe within the pairs of rollers, are accomplished via two compressed air rams 32 and 32' that can be driven in or out. As shown in FIGS. 1–3, the air rams 32 and 32' are attached at their distal ends to the back end of the engaging arms, opposite the rollers, and one attached at their proximal ends to frame 12. This way, upon actuation, the air ram 32 and 32' generate a pivoting motion about the swivel pins. Extension of the air rams tightens the arms upon the pipe, and retraction of the rams releases the drill pipe segment. The engaging arms 14 and 14' are driven uniformly by the air rams to ensure that the drill rod segment contacts both sets of rollers equally and aligns with the center of the receiving space.

The invented system allows the drill pipe segment to be clamped between the engaging arms in firm contact with the serrated rollers. The pipe length may then be spun into, or out of, proper engagement with another pipe length to install or remove long drill strings. The mechanisms involved with engagement and driving of the invented power wrench are both simple and reliable.

For use, the power wrench is typically suspended by a wire cable, or other suitable connection, from a point at or near the top of a drill rig mast. In one embodiment, a cable 34 is connected to the two eyelets 36 and 36' on the power wrench at a height appropriate for manual operation of the tool. The eyelets 36 ans 36' are positioned such that the cable 34 connected from one eyelet to the other intersects the center of gravity of the wrench. With the tool connected, secured, and suspended from the cable in this manner, the machine operator may easily grasp the balanced wrench by a pair of handles and position it near the subject drill pipe or move it to an out of the way place.

The wrench requires the use of a bracing mechanism when operational to counteract the reactionary spinning forces imparted to the device by the drill string. A stop bar (not shown) is employed to brace the power wrench against an available, stable structure such as a mast post. The wrench must be started slowly to allow the stop bar to position itself securely against the mast or other structure.

To initiate operation of the tool, the safety mechanism must first be inactivated. This mechanism prevents unintentional activation of the machine due to accidental contact with the control levers. The safety comprises a means of locking the compressed air control lever in an inactivated state that prohibits movement of the lever without first intentionally releasing the lever. When locked in place, the safety prohibits the arms from engaging. This allows operators and laborers to work safely around the device with minimal risk of accidental injury. When the mechanism is released the arms are free to close upon the subject drill rod. The safety is positioned so that it is easily within the reach of the operator.

To engage, the operator moves the wrench such that the arms surround, and possibly contact, the subject drill rod and the air rams are then actuated to clamp the rod firmly between the pairs of rollers. With the arms engaged, the rollers are turned by the hydraulic motors until the spinning procedure is satisfactorily completed, i.e., until the male end of one rod is tightly seated within, or removed from, the female end of another.

Although this invention has been described above with reference to particular means, materials and embodiments, it is to be understood that the invention is not limited to these disclosed particulars, but extends instead to all equivalents within the scope of the above description, included drawings and the following claims.

I claim:

1. A pipe spinning tool for connecting and disconnecting threaded pipe segments, comprising:

a frame and two first and second engaging arms pivotally mounted to the frame, the two engaging arms defining a pipe receiving space between them;

two drive systems, one of said drive systems being attached to each of said two engaging arms, each of said drive systems comprising:

a motor with a motor axle and a double drive sprocket on said motor axle;

two rollers, both of which rollers are spaced apart from said motor, each of said two rollers having a roller axle which is generally parallel to the motor axle, and a roller sprocket;

two drive chains, each of which drive chains connect a drive sprocket on said motor axle to a roller sprocket on said roller axle; and an engagement assembly for securing lengths of pipe within the pipe receiving space between said two engaging arms, said engagement assembly comprising two compressed air rams with proximal and distal ends, both of said rams being connected to said frame at their proximal ends, and one ram being connected to the first engaging arm at the one ram's distal end, and the other ram being connected to the second engaging arm at the other ram's distal end.

2. The tool of claim 1 wherein the motor is a hydraulic motor.

* * * * *

Disclaimer

6,920,808 — Vernon Rauch, Garden Valley, ID (US). DOUBLE-ACTION POWER PIPE WRENCH. Patent dated July 26, 2005. Disclaimer filed March 10, 2006, by the inventor.

Hereby enters this disclaimer to claims 1 and 2 of said patent.

*(Official Gazette, May 27, 2008)*